US009127525B2

(12) United States Patent
Nguyen

(10) Patent No.: US 9,127,525 B2
(45) Date of Patent: Sep. 8, 2015

(54) MULTI-COMPONENT C-RING COUPLING

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 548 days.

(21) Appl. No.: 13/144,289

(22) PCT Filed: Feb. 23, 2010

(86) PCT No.: PCT/US2010/025120

§ 371 (c)(1),
(2), (4) Date: Jul. 12, 2011

(87) PCT Pub. No.: WO2010/117507

PCT Pub. Date: Oct. 14, 2010

(65) Prior Publication Data

US 2011/0284206 A1 Nov. 24, 2011

Related U.S. Application Data

(60) Provisional application No. 61/165,497, filed on Mar. 31, 2009.

(51) Int. Cl.

| | |
|---|---|
| ***E21B 19/16*** | (2006.01) |
| ***F16L 21/06*** | (2006.01) |
| ***E21B 33/038*** | (2006.01) |

(52) U.S. Cl.
CPC ..... *E21B 33/038* (2013.01); *Y10T 29/49948* (2015.01)

(58) Field of Classification Search
CPC ..... E21B 33/04
USPC ..... 166/96.1, 75.13, 379; 285/123.4, 123.5, 285/123.14, 123.11
See application file for complete search history.

(56) References Cited

U.S. PATENT DOCUMENTS

| | | | | |
|---|---|---|---|---|
| 1,604,580 | A * | 10/1926 | Jaques | 285/123.7 |
| 2,216,481 | A | 10/1940 | Wolferz | |
| 4,753,461 | A | 6/1988 | Miller | |
| 4,936,382 | A * | 6/1990 | Thomas | 166/88.2 |
| 5,135,266 | A * | 8/1992 | Bridges et al. | 285/123.7 |
| 5,158,326 | A | 10/1992 | Anderson et al. | |

(Continued)

FOREIGN PATENT DOCUMENTS

| | | |
|---|---|---|
| GB | 2257995 | 1/1993 |
| SU | 480825 | 8/1975 |

OTHER PUBLICATIONS

PCT Search Report and Written Opinion of PCT Application No. PCT/US2010/025120 mailed Sep. 23, 2010.

(Continued)

*Primary Examiner* — Kenneth L Thompson
(74) *Attorney, Agent, or Firm* — Fletcher Yoder P.C.

(57) ABSTRACT

A multi-component C-ring coupling is provided that includes a connector, an internal C-ring, and a lower ring. In one embodiment, the multi-component C-ring coupling may include a diverter connector to weldlessly couple a diverter to a pipe, such as a conductor. In other embodiment, the coupling may include a casing housinghead connector to couple to a casing housinghead. The lower ring may be engaged with the connector via axial fasteners. The lower ring and connector may include angled internal surfaces to exert radial forces on the C-ring and cause engagement of the teeth of the C-ring with the outer wall of a pipe.

33 Claims, 5 Drawing Sheets

(56) References Cited

U.S. PATENT DOCUMENTS

| | | | | |
|---|---|---|---|---|
| 5,205,356 | A | 4/1993 | Bridges et al. | |
| 5,299,644 | A * | 4/1994 | Eckert | 166/379 |
| 5,314,014 | A | 5/1994 | Tucker | |
| 5,332,043 | A | 7/1994 | Ferguson | |
| 5,899,507 | A * | 5/1999 | Schroeder et al. | 285/343 |
| 5,947,527 | A * | 9/1999 | Carter | 285/4 |
| 7,069,987 | B2 | 7/2006 | Kwasniewski et al. | |
| 7,111,688 | B2 * | 9/2006 | vanBilderbeek | 166/382 |
| 7,207,606 | B2 * | 4/2007 | Owen et al. | 285/339 |
| 8,061,419 | B2 * | 11/2011 | Khazanovich et al. | 166/89.3 |
| 2004/0150225 | A1 | 8/2004 | Roberts et al. | |
| 2004/0173348 | A1 | 9/2004 | Kwasniewski et al. | |

OTHER PUBLICATIONS

International Preliminary Report and Written Opinion for PCT Application No. PCT/US2010/025120 dated Oct. 13, 2011.

Written Opinion for Singapore Application No. 201105507.6 dated Aug. 17, 2012.

Great Britain Examination Report for Application No. GB1118136.9 dated Feb. 1, 2013.

* cited by examiner

MULTI-COMPONENT C-RING COUPLING

CROSS REFERENCE TO RELATED APPLICATIONS

This application claims priority to and benefit of PCT Patent Application No. PCT/US2010/025120, entitled "Multi-Component C-Ring Coupling," filed Feb. 23, 2010, which is herein incorporated by reference in its entirety, and which claims priority to and benefit of U.S. Provisional Patent Application No. 61/165,497, entitled "Multi-Component C-Ring Coupling", filed on Mar. 31, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations.

Couplings (also referred to as connectors) are employed to attach certain components together and to wellhead housings. During drilling and construction of the well, coupling techniques may include welding or machining the components and/or the connector, such as by welding two components together, machining threads or other fastening mechanism into the component and/or connector.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present invention include a multi-component C-ring coupling having a removably coupling lower ring to enable easier removal and inspection of the coupling. Additionally, the coupling may provide attachment of a diverter or riser to a pipe (such as a conductor) without welding. In one embodiment, the multi-component C-ring connector includes a sliplock connector, such as for a diverter or a casing housinghead, a lower ring, and an internal C-ring. The lower ring may be removably coupled to the connector via axial fasteners or a threaded connection. The lower ring may be axially translated until it engages the C-ring. The lower ring and connector include internal angled surfaces such that when the lower ring is engaged the lower ring and connector exert axial and radial forces on the internal C-ring. The resulting radial force pushes teeth of the C-ring radially inward to cause the teeth to bite a pipe. In other embodiments, the connector may include radial fasteners inserted into the connector to engage the internal C-ring.

Figure 1A:
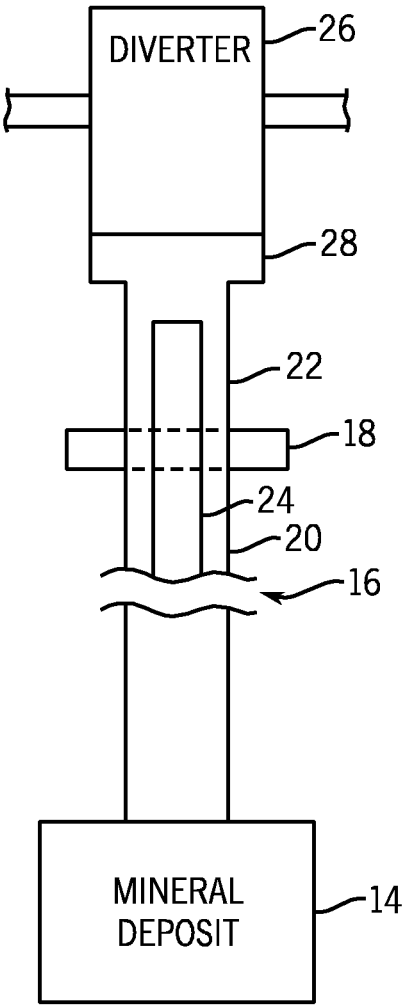
FIGS. 1A and 1B are block diagrams of a mineral extraction system in accordance with an embodiment of the present invention.
Figure 1B:
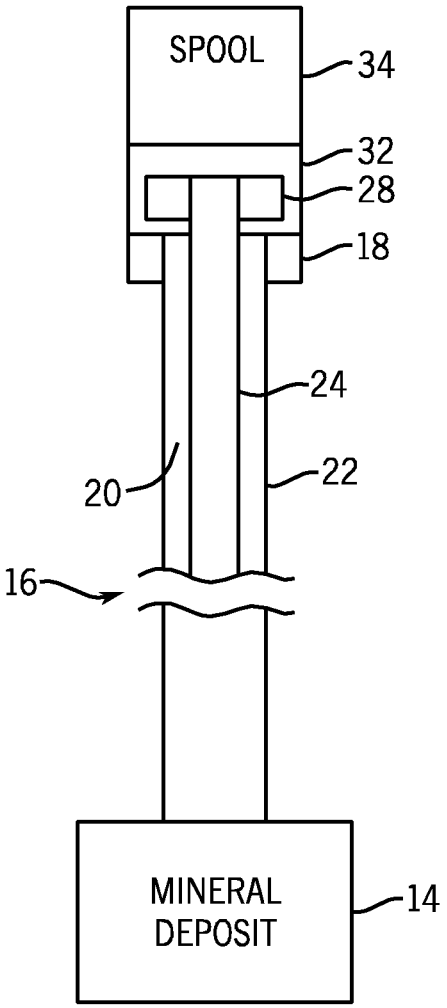

FIGS. 1A and 1B are a block diagrams that illustrates an embodiment of a mineral extraction system 10. As discussed below, one or more tubular couplings are employed throughout the system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead assembly 12 coupled to a mineral deposit 14 via a well 16, wherein the well 16 includes a wellhead hub 18 and a well-bore 20. The wellhead hub 18 generally includes a large diameter hub that is disposed at the termination of the well-bore 20. The wellhead hub 18 provides for the sealable connection of the wellhead assembly 12 to the well 16.

The wellhead assembly 12 typically includes multiple components that control and regulate activities and conditions associated with the well 16. For example, the wellhead assembly 12 generally includes pipes, bodies, valves and seals that enable drilling of the well 16, route produced minerals from the mineral deposit 14, provide for regulating pressure in the well 16, and provide for the injection of chemicals into the well-bore 20 (down-hole). For example, FIG. 1A illustrates a conductor 22 (also referred to as "conductor casing") disposed in the well 20 to provide structure for well and prevent collapse of the sides of the well 26 into the well-bore 20. One or more casings 24, such as surface casing, intermediate casing, etc., may be fully or partially disposed in the bore of the conductor 22. The casing 24 also provides a structure for the well 16 and well-bore 20 and provides for control of fluid and pressure during drilling of the well 16.

During various stages of drilling of the well 16, a diverter 26 (or a riser or other pipe) may be coupled to the conductor 22 via the multi-component C-ring coupling 28. The diverter 26 (also referred to as a type of blowout preventer (BOP). The diverter 26 may include a variety of valves, fittings and controls to prevent oil, gas, or other fluid from exiting the well in the event of an unintentional release of pressure or an unanticipated overpressure condition. The diverter 26 may be mechanically or hydraulically operated and may allow diversion of fluids flowing from the well 16 away from rig or other equipment via side outlets 30. During operation of the system 10, it may be typical to install a diverter 26 during removal or installation of additional components, changes in operation of the system 10, or for other safety reasons. As described further below, the multi-component C-ring coupling 28 enables secure coupling of the diverter 26 to the conductor 22 without welding.

FIG. 1B depicts another operation of the wellhead assembly 12 illustrating installation of additional casing 24, such as additional surface casing, intermediate casing, or production casing, to the wellhead assembly 12. To install additional casing, a casing housinghead 32 may be coupled to the casing 24 via the multi-component C-ring coupling 28. Again, as described further below, the multi-component C-ring coupling 28 enables coupling of the casing housinghead 32 to the casing 24 without welding. The casing housinghead 32 may provide for installation of additional components, such as a BOP or a casing spool 34. The casing spool 34 may provide for installation of additional casing, such as through use of a casing hanger installed inside the casing spool 34.

Figure 2:
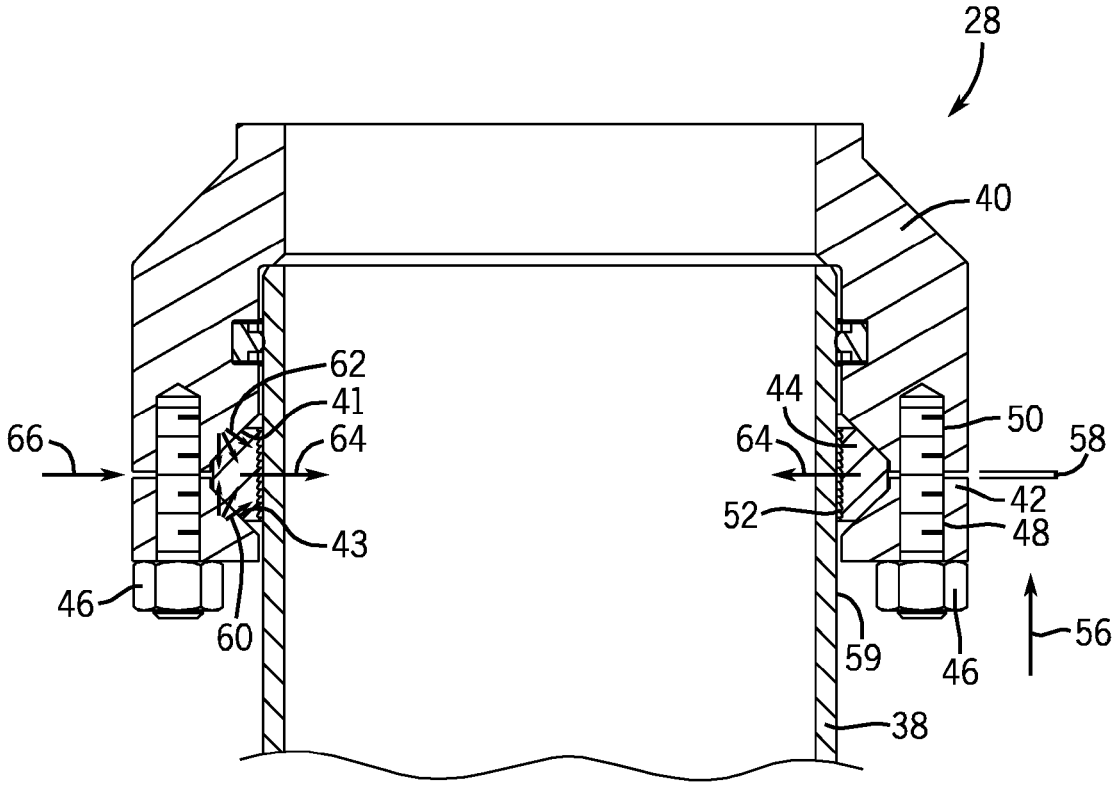
FIG. 2 is a cross-section of the multi-component C-ring coupling with a diverter connector in accordance with an embodiment of the present invention.

FIG. 2 depicts a cross-section of the multi-component C-ring coupling 28 coupled to a portion of a pipe 38, such as the conductor 22, the casing 24, or any other pipe. The multi-component C-ring coupling 28 includes a converter connector 40, a lower ring 42, and an internal C-ring 44. For example, the connector 40 may couple to the pipe 38 by one or more seals 42. The connector 40 includes an internal angled surface 41 and the lower ring includes an internal angled surface 43 generally angularly opposed to the internal angled surface 41, such that the surfaces 41 and 43 generate equal radial forces between the surfaces 41 and 43 and the internal C-ring 44.

In the embodiment depicts in FIG. 2, the lower ring 42 may be removably coupled to the connector 40 via one or more axial fasteners 46 inserted into receptacles 48 of the lower ring 42. The axial fasteners 46 may insert through the receptacles 48 and into a recess 50 of the connector 40. In some embodiments, the receptacles 48, the recesses 50, the fasteners 46, or any combination thereof may be threaded to facilitate engagement between the receptacles 48, the recesses 50, and the fasteners 46. In certain embodiments, the fasteners 46 may be bolts, screws, or any suitable fastener.

The internal C-ring 44 includes teeth 52 that extend radially inward toward the pipe 38. The teeth 52 extend to and bite the outer wall 54 of the pipe 38 to secure the coupling 28 to the pipe 38. As described in detail below, the teeth 52 of the internal C-ring 44 are radially engaged via the axial and generally uniform radial force applied by the axial compression between the lower ring 42 and connector 40.

To engage the coupling 28, the lower ring 42 may by moved in the axial direction, indicated by arrow 56, by engaging the axial fasteners 46 into the connector 40, reducing the axial gap 58 between the connector 40 and the lower ring 42. The fasteners 46 may be tightened in an alternating cross-pattern to the desired torque. In certain embodiments, the coupling 28 may include between approximately 1 to 50, 2 to 40, 3 to 30, 4 to 20, or 5 to 10 fasteners 46 equally spaced about a circumference of the coupling 28.

As the lower ring 42 moves in the axial direction indicated by arrow 56, the internal angled surface 43 comes into contact with the internal C-ring 44, exerting axial and radial forces on the internal C-ring 44, as indicated by arrow 60. Similarly, as the gap 58 reduces, the internal angled surface 41 of the connector 40 exerts opposite radial and axial forces on the internal C-ring 44, as indicated by arrow 62. The combination of the forces indicated by arrows 60 and 62 results in a generally uniform radial force (indicated by arrow 64) on the internal C-ring 44 due to the angled surfaces 41 and 43 engaging the internal C-ring 44. This radial force indicated by arrow 64 forces the teeth 52 radially inward to bite into the outer wall 54 of the pipe 38. An operator may visually verify the status of the internal C-ring through the gap 58 to ensure the teeth 52 of the C-ring 44 fully bit the pipe 38.

The angle of the surfaces 41 and 43 may be designed for engagement with the internal C-ring 44 and/or for the desired radial force on the C-ring 44. In some embodiments, the internal angled surface 41 and/or the internal angled surface 43 may be angled at least less than approximately 90° relative to a central axis of the tubing, e.g., approximately 10°, 20°, 30°, 40°, 45°, 50°, 60°, 70°, 80°, etc. For example, in certain embodiments, the internal angled surface 41 and/or the internal angled surface 43 may be angled between approximately 30 to 60°, between approximately 40 to 50°, or approximately 45°. Moreover, the internal angled surface 41 and the internal angled surface 43 may have the same or different angles from one another.

Additionally, the multi-component C-ring coupling 28 provides the ability to verify the status of the internal C-ring 44 without removal or disassembly of the coupling 28. After installation, the gap 58 between the connector 40 and the lower ring 42 may be maintained, allowing visible verification of the internal C-ring 44. For example, the thickness of the internal C-ring 44 may provide for the gap 58 up to a specific torque on the fasteners 26. An operator may view the status of the internal C-ring 44 by looking through the gap 58, as indicated by arrow 66. In this manner, the integrity of the internal C-ring 44 may be verified without removal or disassembly of the coupling 28.

Additionally, removal of the multi-component C-ring coupling 28 may be easier and safer than conventional couplings. To remove the multi-component C-ring coupling 28, the lower ring 42 may be removed by removing the axial fasteners 46 from the connector 40. The removability of the lower ring 42 enables an operator to view and easily remove the axial and radial forces (indicated by arrow 62) applied to the internal C-ring 44 and, thus, easily remove or reduce the radial force (indicated by arrow 64) engaging the teeth 52 of the internal C-ring 44 with the outer wall of the pipe 38.

Figure 3:
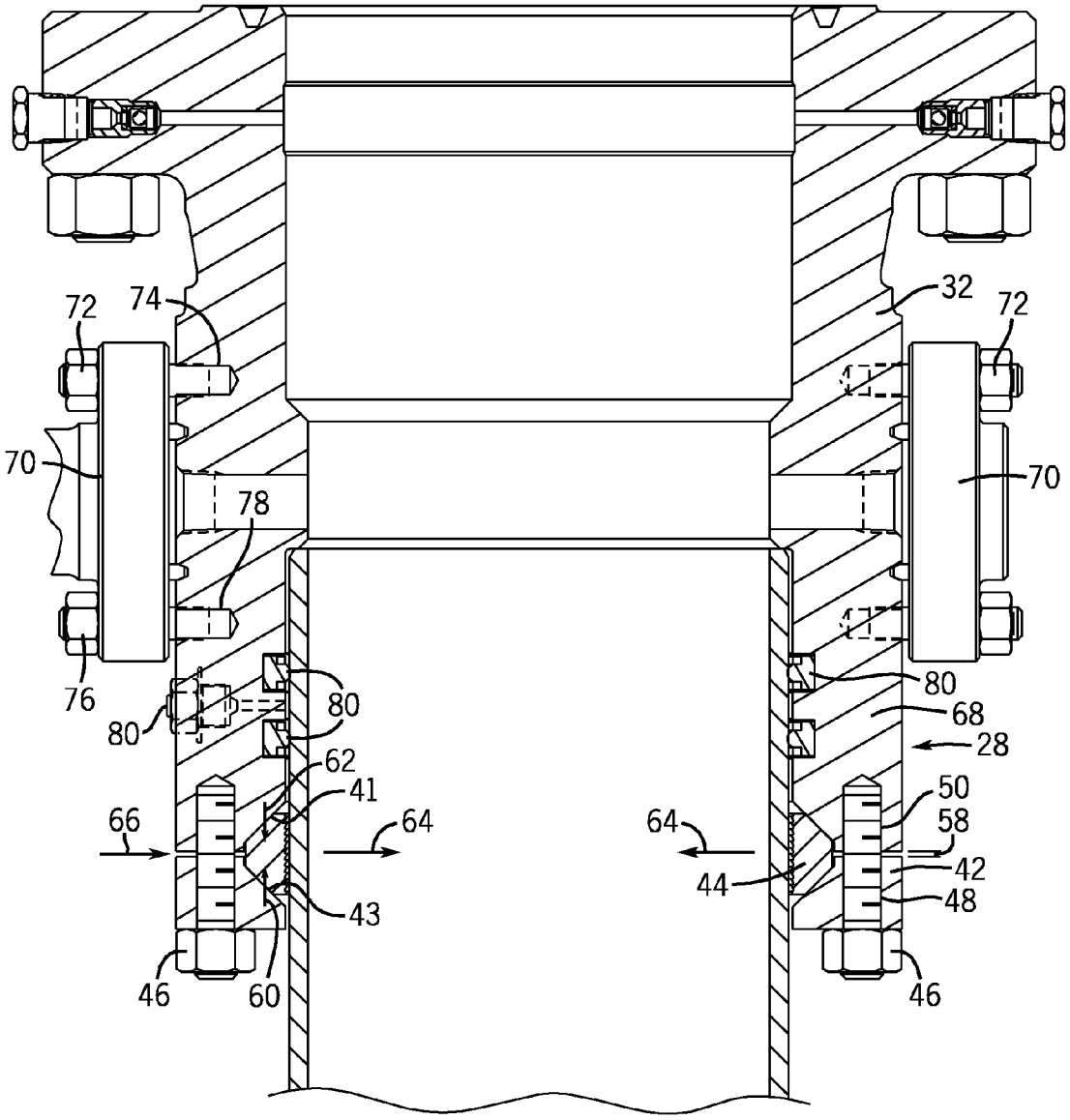
FIG. 3 is a cross-section of the multi-component C-ring coupling with a casing housinghead connector in accordance with an embodiment of the present invention.

FIG. 3 is a cross-section of the casing housinghead 32 coupled to a pipe 38 via the multi-component C-ring coupling 28 in accordance with an embodiment of the present invention. In the embodiment depicted in FIG. 3, the casing housinghead 32 may be coupled to a casing housinghead connector 68 of the multi-component C-ring coupling 28 via the one or more flanges 70. The flanges 70 may include fasteners 72 to couple to the casing housinghead 32 via recesses 74. The flanges 70 may also include fasteners 76 to couple to the connector 68 via recesses 78. In the embodiment depicted in FIG. 3, the connector 68 may include annular seals 80, such as O-rings, to seal and secure the connector 40 to the outer wall 54 of the pipe 38.

In certain embodiments, the connector 68 may be an existing connector for the casing housinghead 32. In such an embodiment, recesses 50 may be machined or otherwise formed in the connector 68 to receive the fasteners 46. As shown in FIG. 3 and as described above, to secure the coupling 28 to the pipe 38 the lower ring 42 may be axially moved via the engagement of fasteners 46 to reduce the gap 58 and apply axial and radial force to the internal C-ring 44 (as indicated by arrows 60 and 62). Additionally, in some embodiments the connector 68 may include one or more test ports 80 to test the integrity of the annular seals 80. Further, the cost of the housinghead 32 may be reduced by using a standard forging for the housinghead 32.

Figure 4:
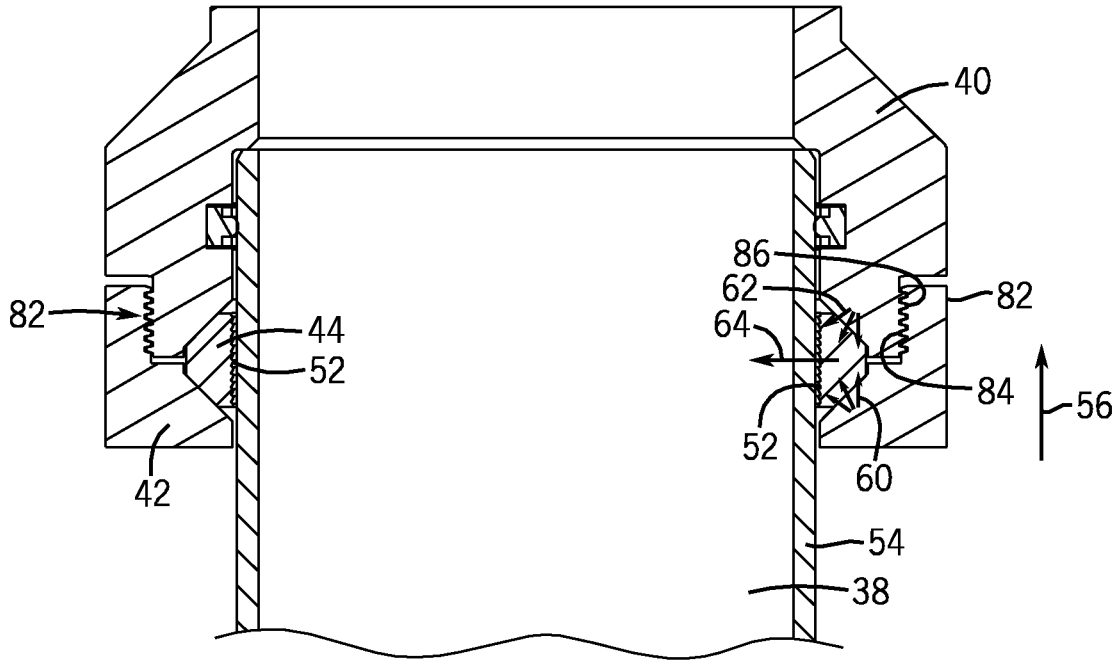
FIG. 4 is a cross-section of the multi-component C-ring coupling with a threaded connection in accordance with another embodiment of the present invention.

FIG. 4 is an alternate embodiment of the multi-component C-ring coupling 28 having a threaded connection 82 between the lower ring 42 and the diverter connector 40. As shown in FIG. 4, the coupling 28 does not include any fasteners in the lower ring 42 and the connector 40. Instead, the lower ring 42 includes internal threads 84. The connector 40 may include external threads 86 configured to couple to the internal thread 84 of the lower ring 42. To engage the lower ring 42, the lower ring 42 may be threaded onto the threaded connection 82 and rotated to cause axial movement (indicated by arrow 56) to engage the lower ring 42 and connection 40 with the internal C-ring 44. The threaded connection 82 between the lower ring 42 and the connection 40 provides the same advantages discussed above with regard to the embodiments depicted in FIGS. 2 and 3. That is, the lower ring 42 may be axially translated until the axial forces (depicted by arrows 60 and 62) exert on the internal C-ring 44, causing a generally uniform radial inward force (indicated by arrow 64) to cause the teeth 52 to bite the outer wall 54 of the pipe 38. Similarly, to release or remove the coupling 28, the lower ring 42 may be disengaged from the threaded connection 82, removing or reducing the axial and radial force on the internal C-ring 44.

Figure 5:
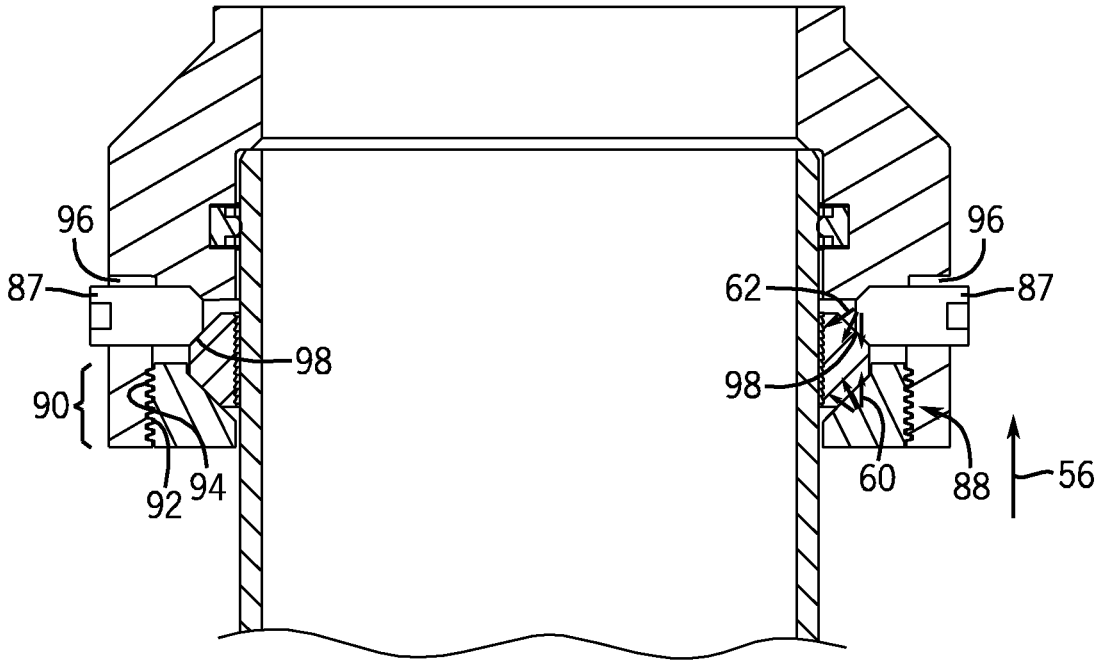
FIG. 5 is a cross-section of the multi-component C-ring coupling with a threaded connection and radial fasteners in accordance with another embodiment of the present invention.

FIG. 5 depicts an alternate embodiment of the multi-component C-ring 28 having one or more radial fasteners 87 and a threaded connection 88. The lower ring 42 may be removably coupled to the connector 40 via the threaded connection 88. In the embodiment depicted in FIG. 5, the connector 40 includes an extended portion 90 that extends fully or partially over the lower ring 42. The extended portion 90 includes internal threads 92, and the lower ring 42 includes external threads 94 configured to engage with the internal threads 92 and form threaded connection 88.

As shown in FIG. 5, the connector 40 does not include the internal angled surface 41. Instead, the connector 40 includes one or more receptacles 96 disposed above the lower ring 42. The radial fasteners 87 may be inserted radially into the receptacles 96 to engage the internal C-ring 44. In such embodiment, the fasteners 87 and the receptacles 96 may be threaded to facilitate engagement between the fasteners 87 and the receptacles 96. The radial fasteners 87 include an angled surface 98 (e.g., a conical tip portion) angularly opposed to the angled surface 43 of the lower ring 42. In such an embodiment, the angled surface 98 of the fasteners 87 exerts an axial force on the internal C-ring 44 (indicated by arrow 62) when the fastener 87 is engaged.

The coupling 28 of FIG. 5 may be installed by first inserting the fasteners 87, and then engaging the lower ring 42 to the connector 40 via the threaded connection 88. The lower ring 42 may be axially translated along the threaded connection 88 until the lower ring 42 engages the internal C-ring 44. Alternatively, the coupling 28 may be installed by first engaging the lower ring 42 onto the threaded connection 88, and subsequently inserting the fasteners 87. To remove the coupling 28 depicted in FIG. 5, the lower ring 42 may be first removed and then the fasteners 87 may be subsequently removed. Alternatively, the fasteners 87 may be first removed and then the lower ring 42 may be subsequently removed.

Although the embodiment above discuss a diverter, riser, or casing housinghead, it should be appreciated that the multi-component C-ring coupling may be used to couple any wellhead component to a pipe, such as a conductor, casing, etc. The connector of the coupling may be modified for engagement with any such wellhead component.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a coupling for a wellhead component, wherein the coupling comprises:

a connector configured to couple to the wellhead component, wherein the connector or a radial fastener coupled to the connector has a first angled internal surface;

a lower ring removably coupled to the connector via one or more threaded connections, wherein the lower ring has a second angled internal surface, the first and second angled internal surfaces are angled away from one another in a radial direction inwardly toward a longitudinal axis of the coupling, the first and second angled internal surfaces have respective first and second angles that are less than or equal to approximately 60 degrees relative to the longitudinal axis, and the first and second angles are substantially equal and opposite relative to the longitudinal axis; and an internal ring axially and radially captured between the first angled internal surface of the connector or the radial fastener and the second angled internal surface of the lower ring, wherein the one or more threaded connections are configured to cause upward movement of the lower ring in an upward axial direction toward a bottom of the connector, and the upward movement of the lower ring is configured to drive the first and second angled internal surfaces axially toward one another to bias the internal ring in the radial direction toward the longitudinal axis, and the internal ring comprises a circumferential break extending completely through and separating the internal ring.

2. The system of claim 1, wherein the internal ring comprises teeth oriented in the radial direction to engage the wellhead component.

3. The system of claim 1, wherein the internal ring comprises a C-ring or a split ring having the circumferential break.

4. The system of claim 1, comprising a mineral extraction system having the coupling and the wellhead component, wherein the wellhead component comprises casing, tubing, or any other pipe.

5. The system of claim 1, wherein the one or more threaded connections comprise bolts, screws, or any combination thereof.

6. The system of claim 1, wherein the one or more threaded connections comprise first threads disposed directly on the connector and second threads disposed directly on the lower ring, wherein the first and second threads engage one another to move the lower ring in the upward axial direction toward the connector.

7. The system of claim 1, comprising an axial gap between the connector and the lower ring to enable viewing of the internal ring.

8. The system of claim 1, wherein the first and second angles are less than or equal to 45 degrees and substantially equal and opposite relative to the longitudinal axis.

9. The system of claim 1, wherein the first and second angles are between approximately 30 to 60 degrees.

10. The system of claim 1, wherein the one or more threaded connections comprise a plurality of threaded fasteners oriented in an axial direction relative to the longitudinal axis, and the plurality of threaded fasteners extend axially through a bottom of the lower ring into receptacles in the connector.

11. The system of claim 1, wherein the first angled internal surface is disposed on the radial fastener, and the radial fastener is threaded into a receptacle in the connector.

12. The system of claim 1, wherein the first angled internal surface is disposed directly on the connector.

13. The system of claim 12, wherein the internal ring is disposed directly between and in contact with both the first angled internal surface on the connector and the second angled internal surface on the lower ring.

14. The system of claim 1, wherein the lower ring is coupled only to the connector.

15. The system of claim 1, wherein the first and second angles are between approximately 40 to 50 degrees.

16. A system, comprising:

a pipe;

a first wellhead component coupled to the pipe;

a coupling coupled to the first wellhead component, the coupling comprising:

a one-piece slip lock connector coupled to the first wellhead component and the pipe, wherein the one-piece slip lock connector or a radial fastener coupled to a radial bore of the one-piece slip lock connector comprises a first internal contour;

a lower ring removably coupled to the one-piece slip lock connector via one or more fasteners, wherein the lower ring comprises a second internal contour opposed to the first internal contour of the one-piece slip lock connector or the radial fastener, and the first and second internal contours have respective first and second angles that are less than 90 degrees relative to a longitudinal axis of the coupling; and an internal ring disposed directly between and in contact with the first internal contour and the second internal contour, wherein the one or more fasteners are configured to cause upward movement of the lower ring in an upward axial direction toward a bottom of the one-piece slip lock connector, and the upward movement of the lower ring is configured to drive the first and second internal contours axially toward one another to bias the internal ring in a radial direction toward the longitudinal axis to exert a radial force on the pipe.

17. The system of claim 16, wherein the pipe comprises casing, tubing, or other wellhead pipe.

18. The system of claim 16, wherein the first wellhead component comprises a diverter, a riser, a casing housinghead, or a casing head.

19. The system of claim 16, wherein the internal ring comprises teeth configured to radially engage an outer wall of the pipe.

20. The system of claim 16, wherein the first and second angles are less than or equal to approximately 60 degrees.

21. The system of claim 16, wherein the first and second angles are less than or equal to approximately 45 degrees.

22. The system of claim 16, wherein the first and second angles are substantially equal and opposite relative to the longitudinal axis.

23. The system of claim 16, wherein the internal ring comprises a circumferential break extending completely through and separating the internal ring.

24. The system of claim 16, wherein the one or more fasteners comprise one or more bolts extending axially through a bottom of the lower ring into receptacles in the one-piece slip lock connector.

25. The system of claim 16, wherein the lower ring is not directly coupled to any tubing.

26. A method, comprising:

positioning a coupling around a tubing of a wellhead, wherein the coupling comprises a connector having a first angled internal surface, a lower ring having a second angled internal surface, and an internal ring axially and radially captured between the first and second angled internal surfaces relative to a longitudinal axis of the coupling, wherein the first and second angled internal surfaces are angled away from one another in a radial direction inwardly toward the longitudinal axis of the coupling, wherein the first and second angled internal surfaces have respective first and second angles that are less than or equal to approximately 60 degrees relative to the longitudinal axis, wherein the first and second angles are substantially equal and opposite relative to the longitudinal axis;

engaging at least one threaded connection to move the lower ring in an upward axial direction toward a bottom of the connector to drive the first and second angled internal surfaces axially toward one another to bias the internal ring in the radial direction toward the longitudinal axis, wherein the internal ring comprises a circumferential break extending completely through and separating the internal ring; and securing the coupling to the tubing with a radial force from the internal ring onto an exterior surface of the tubing as the internal ring is biased in the radial direction.

27. The method of claim 26, comprising applying substantially equal forces from the first and second angled internal surfaces onto the internal ring via the substantially equal and opposite first and second angles of the first and second angled internal surfaces relative to the longitudinal axis.

28. The method of claim 26, wherein the substantially equal and opposite first and second angles are less than or equal to approximately 45 degrees.

29. The method of claim 26, wherein securing comprises engaging teeth of the internal ring against the exterior surface of the tubing.

30. The method of claim 26, wherein engaging the at least one threaded connection comprises rotating the lower ring relative to the connector to engage first threads of the connector with second threads of the lower ring to move the lower ring in the upward axial direction toward the bottom of the connector.

31. The method of claim 26, wherein engaging the at least one threaded connection removably coupling the lower ring to the connector with a plurality of threaded fasteners oriented in an axial direction relative to the longitudinal axis, and the plurality of threaded fasteners extend axially through a bottom of the lower ring into receptacles in the connector.

32. The method of claim 26, wherein the internal ring comprises a C-ring having the circumferential break.

33. The method of claim 26, wherein the internal ring is disposed directly between and in contact with both the first angled internal surface on the connector and the second angled internal surface on the lower ring.

* * * * *